US005404688A

United States Patent [19]

Greaves

[11] Patent Number: 5,404,688

[45] Date of Patent: Apr. 11, 1995

[54] MATRIX FOR REINFORCING CONCRETE

[76] Inventor: William S. Greaves, 19 McMaster Ave., Toronto, Ontario, Canada, M4V 1A8

[21] Appl. No.: 145,111

[22] Filed: Nov. 3, 1993

[51] Int. Cl.[6] ..... E04C 5/00

[52] U.S. Cl. ..... 52/648.1; 52/649.1; 52/659

[58] Field of Search ..... 52/648.1, 649.1, 649.6, 52/652.1, 659, 638

[56] References Cited

U.S. PATENT DOCUMENTS

| | | | |
|---|---|---|---|
| 957,244 | 5/1910 | Noyes | 52/659 OR |
| 1,349,868 | 8/1920 | Atterbury | 52/649.1 X |
| 1,976,832 | 10/1934 | Brown | 52/659 OR |
| 2,140,283 | 12/1938 | Faber | 52/649.1 X |
| 2,347,449 | 4/1944 | Whitehall | 52/659 OR |
| 2,458,242 | 1/1949 | Bescherer | 52/659 OR |
| 3,400,507 | 9/1968 | MacChesney . | |
| 3,552,277 | 1/1971 | Avital | 52/659 OR |
| 3,616,589 | 11/1971 | Sherard . | |
| 3,705,473 | 12/1972 | Yeffal-Rueda | 52/649.1 OR |
| 3,808,085 | 4/1974 | Givens, Jr. | 52/659 X |
| 3,913,295 | 10/1975 | Thompson . | |
| 3,996,713 | 12/1976 | Haeussler | 52/649.1 X |
| 4,565,840 | 1/1986 | Kobayashi et al. | 52/659 X |
| 5,097,646 | 3/1992 | Lamle . | |
| 5,145,285 | 9/1992 | Fox et al. . | |

FOREIGN PATENT DOCUMENTS

| | | | |
|---|---|---|---|
| 2239115 | 2/1974 | Germany | 52/659 OR |

*Primary Examiner*—Carl D. Friedman
*Assistant Examiner*—Wynn E. Wood
*Attorney, Agent, or Firm*—Jeffrey T. Imai; Arne I. Fors; D. Doak Horne

[57] ABSTRACT

An element for reinforcing concrete comprises a framed structure having a plurality of rods formed in a polyhedral shape defining a plurality of junctions. At least one junction extends into the framed structure of another of the elements.

20 Claims, 2 Drawing Sheets

MATRIX FOR REINFORCING CONCRETE

FIELD OF INVENTION

This invention relates to a matrix for reinforcing concrete. In particular, this invention relates to a framed polyhedral element for reinforcing concrete.

BACKGROUND OF INVENTION

It is well know in the art of cement and concrete to increase physical properties by adding reinforcing materials such as strands of wire or glass fibers. For large scale installations where strength is most important, steel rods are used to increase the strength of the concrete. The rods can either be prestresses, relaxed or tied together in an intricate pattern to improve the physical properties. However, this process is time consuming and costly.

There are other known methods of improving the strength of cement or concrete with the use of discrete elements which are mixed with the cement and upon curing improve the overall strength over non-reinforced concrete. Such elements are disclosed in U.S. Pat. No. 3,400,507, MacChesney, U.S. Pat. No. 3,616,589, Sherard, U.S. Pat. No. 3,913,295, Thompson and U.S. Pat. No. 5,145,285, Fox et al. However, such reinforcing elements do not adequately intersect for forming a matrix and therefore do not significantly improve the strength of the cured concrete.

SUMMARY OF THE INVENTION

The disadvantages of the prior art may be overcome by providing a reinforcing element which intersects with like elements when a plurality of reinforcing elements are mixed in a concrete mass.

According to one aspect of the invention there is provided an element for reinforcing concrete. The element comprises a framed structure having a plurality of rods formed in a polyhedral shape defining a plurality of junctions. Upon mixing a concrete mass and a plurality of the elements, a matrix is formed with the junctions extending into the framed structure of an adjacent element.

According to another aspect of the invention, a reinforced structure can be formed comprising a concrete mass and a plurality of reinforcing elements suspended in and distributed throughout the concrete mass. A combination of reinforcing elements comprise a framed structure having a plurality of rods formed in a plurality of polyhedral shapes defining a plurality of junctions. At least one junction extends into the framed structure of an adjacent element.

According to another aspect of the invention, the plurality of polyhedral shapes may be selected from a group consisting of a tetrahedron, hexahedron and octahedron. The reinforced structure may include a combination of tetrahedron and hexahedron reinforcing elements.

According to another aspect of the invention, the junctions may include at least one rod extension which extends outwardly therefrom to interlock with an adjacent reinforcing element.

According to another aspect of the invention, the junction or rod extension may include a structural element, such as a plate, cube or sphere, for interacting between adjacent reinforcing elements.

DESCRIPTION OF THE DRAWINGS

In drawings which illustrate the preferred embodiment of the invention.

DETAILED DESCRIPTION OF THE INVENTION

Figure 1:
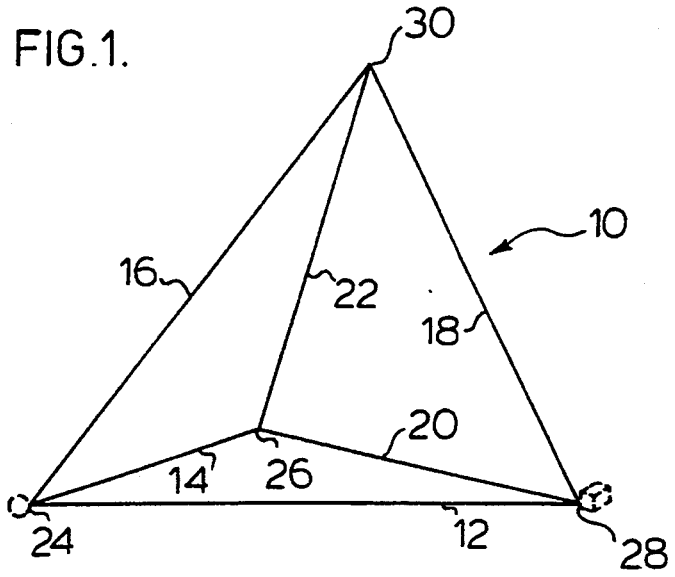
FIG. 1 is a perspective view of a reinforcing element of the present invention.

The reinforcing element of the present invention is generally illustrated in FIG. 1 as 10. The reinforcing element 10 comprises a plurality of rods 12, 14, 16, 18, 20 and 22 joined together forming a framed structure. The rods 12, 14, 16, 18, 20 and 22 are connected at junctions 24, 26, 28 and 30.

Figure 2:
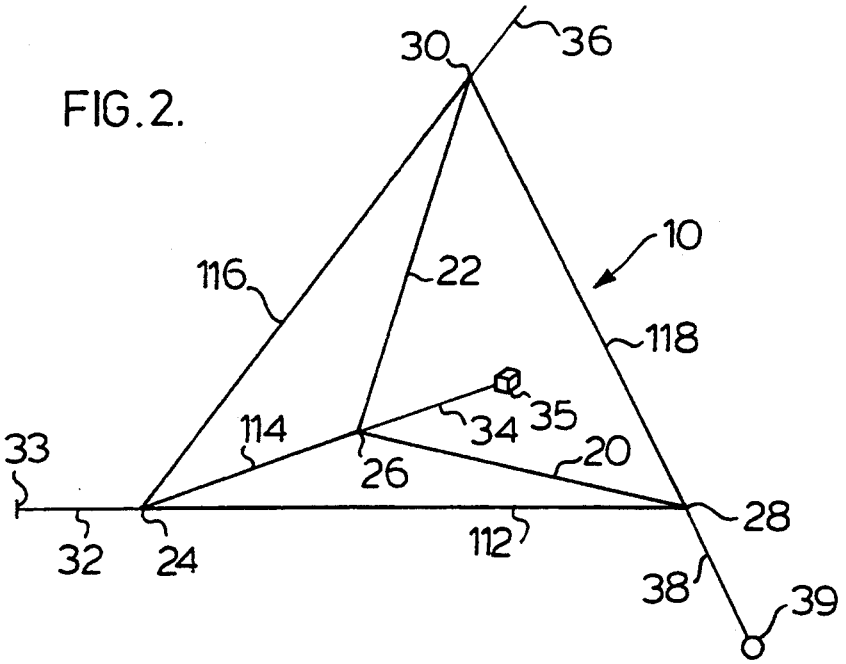
FIG. 2 is a perspective view of the reinforcing element of FIG. 1 with rod extensions and structural elements.

In an alternate embodiment of FIG. 2, rod 112 extends outwardly past junction 24 defining rod extension 32, rod 114 extends outwardly past junction 26 defining rod extension 34, rod 116 extends outwardly past junction 30 defining rod extension 36 and rod 118 extends outwardly past junction 28 defining rod extension 38.

FIG. 2 also illustrates that the junctions or the ends of the rod extensions may have a structural element such as a flat plate 33, a cube 35 or a sphere 39 attached thereto. Flat plate 33, cube 35 or sphere 39 increase the interaction between reinforcing elements when a junction or a rod extends into the framed section of an adjacent element. The tensile strength of the concrete is thereby increased.

Figure 3:
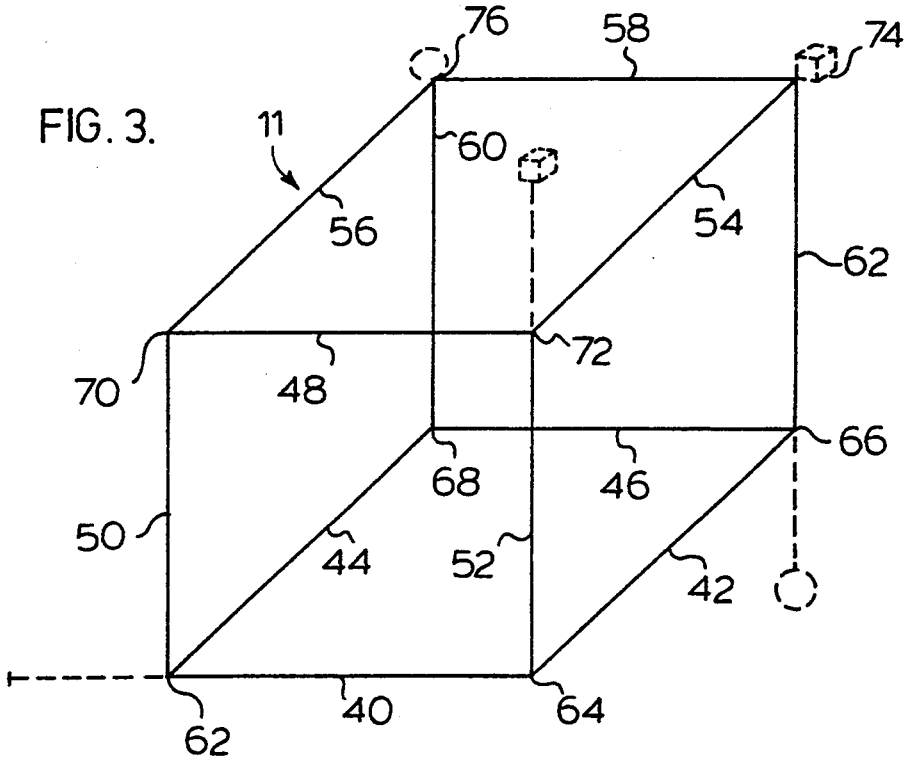
FIG. 3 is a perspective view of a second embodiment of a reinforcing element of the present invention.

Referring to FIG. 3, a hexahedron or cube 11 in the form of a regular cube is illustrated. Rods 40, 42, 44, 46, 48, 50, 52, 54, 56, 58 and 60 are joined together at junctions 62, 64, 66, 68, 70, 72, 74 and 76. Additionally, cube 11 may be fitted with rods in a similar fashion as illustrated with tetrahedron 10 in FIG. 2.

In the preferred embodiment, the rods are welded together. However, it is apparent that other methods of connection are possible. Further, other combinations of bending and welding the rods are possible.

In use, the concrete mass is mixed or tumbled in the known manner using water, aggregates such as sand and gravel, and cement. A plurality of the reinforcing elements 10 are added to the mixture. The plurality of reinforcing elements 10 become randomly mixed in the concrete. The mixture is poured in the conventional manner.

Figure 4:
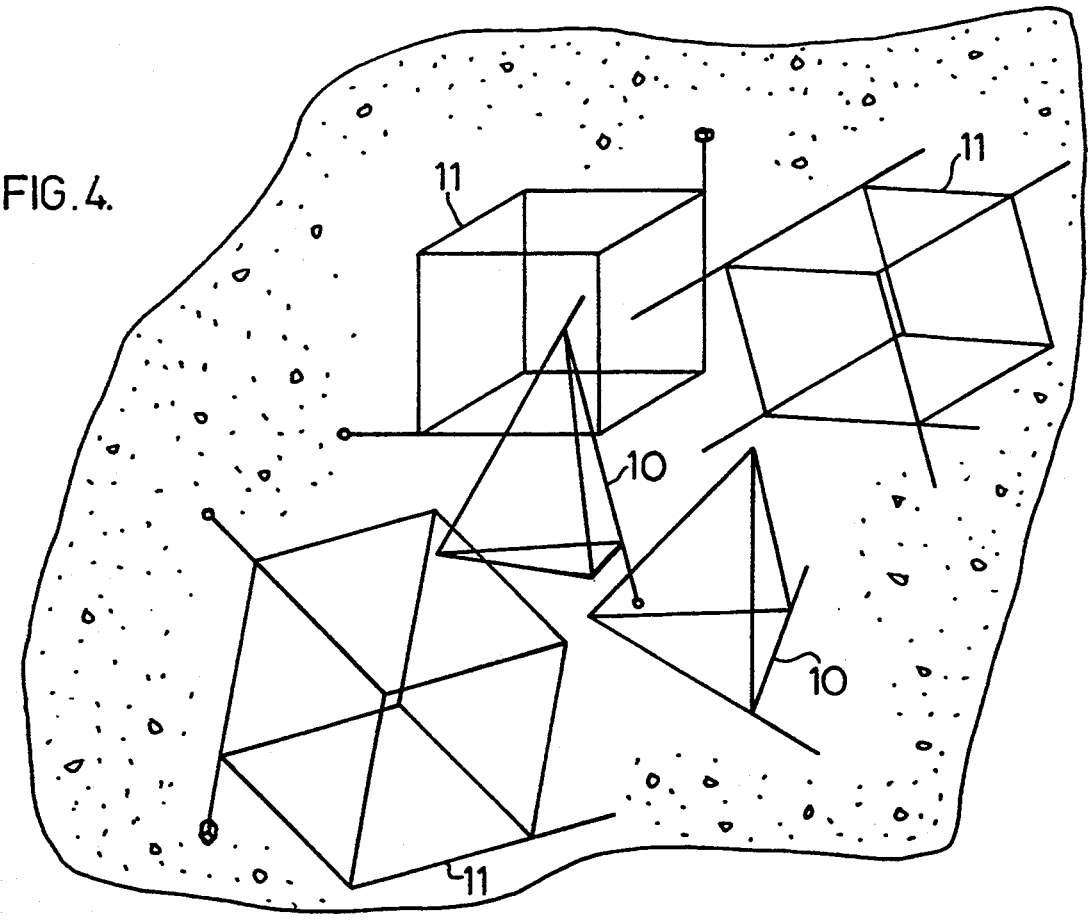
FIG. 4 is a view showing randomly interrelated reinforcing elements embedded in concrete.

Once poured and if the density of reinforcing elements is sufficient, a junction or a rod of one reinforcing element will extend outwardly from the reinforcing element 10 into the framed structure of an adjacent like reinforcing element, as illustrated in FIG. 4. The protrusion of the junction or rod within the framed structure of an adjacent reinforcing element results in a rigid mass with a matrix of reinforcing elements which improves the strength properties of the concrete mass.

In one embodiment, the polyhedron is a regular tetrahedron. However, it is contemplated that other polyhedrons may be used including hexahedrons and octahedrons. As illustrated in FIG. 4, a plurality of mixed polyhedrons, including tetrahedrons and hexahedrons, can be interspersed in a concrete mass. One of the junctions of one reinforcing element will extend into the framed structure of an adjacent element. The interaction between elements may be improved by adding the extension rods and further improved by adding the structural elements.

Although the disclosure describes and illustrates preferred embodiments of the invention, it is to be understood that the invention is not limited to these particular embodiments. Many variations and modifications will now occur to those skilled in the art. For a definition of the invention, reference is to be made to the appended claims.

I claim:

1. A plurality of concrete reinforcing elements, each element comprising:

a framed structure having a plurality of rods formed in a polyhedral shape defining a plurality of junctions, whereby at least one of said junctions extends into the framed structure of another of said elements.

2. A plurality of reinforcing elements as claimed in claim 1 wherein said polyhedral shape is a regular tetrahedron.

3. A plurality of reinforcing elements as claimed in claim 2 wherein said junctions include at least one rod extension which extends outwardly therefrom.

4. A plurality of reinforcing elements as claimed in claim 3 wherein said rod extension includes a structural element for improving the interaction between adjacent reinforcing elements.

5. A plurality of reinforcing elements as claimed in claim 1 wherein said polyhedral shape is a regular cube.

6. A plurality of reinforcing elements as claimed in claim 5 wherein said junctions include at least one rod extension which extends outwardly therefrom.

7. A plurality of reinforcing elements as claimed in claim 6 wherein said rod extension includes a structural element for interacting between adjacent reinforcing elements.

8. A plurality of reinforcing elements as claimed in claim 5 wherein said junctions include a structural element for interacting between adjacent reinforcing elements.

9. A reinforced structure comprising a concrete mass and a plurality of reinforcing elements suspended in and distributed throughout the concrete mass, each of said reinforcing elements comprising a framed structure having a plurality of rods formed in a polyhedral shape defining a plurality of junctions, whereby at least one said junctions extends into the framed structure of an adjacent element.

10. A reinforced structure as claimed in claim 9 wherein said polyhedral shape is a regular tetrahedron.

11. A reinforced structure as claimed in claim 10 wherein said junctions include at least one rod extension which extends outwardly therefrom.

12. A reinforced structure as claimed in claim 11 wherein said rod extension includes a structural element for interacting between adjacent reinforcing elements.

13. A reinforced structure as claimed in claim 9 wherein said polyhedral shape is a regular cube.

14. A reinforced structure as claimed in claim 13 wherein said junctions include at least one rod extension which extends outwardly therefrom.

15. A reinforced structure as claimed in claim 14 wherein said rod extension includes a structural element for interacting between adjacent reinforcing elements.

16. A reinforced structure comprising a concrete mass and a plurality of reinforcing elements suspended in and distributed throughout the concrete mass, a combination of said reinforcing elements comprising a framed structure having a plurality of rods formed in a plurality of polyhedral shapes defining a plurality of junctions, whereby at least one said junctions extends into the framed structure of an adjacent element.

17. A reinforced structure as claimed in claim 15 wherein said plurality of polyhedral shapes are selected from the group consisting of a tetrahedron, hexahedron and octahedron.

18. A reinforced structure as claimed in claim 15 wherein said plurality of polyhedral shapes are tetrahedron and hexahedron.

19. A reinforced structure as claimed in claim 17 wherein said junctions include at least one rod extension which extends outwardly therefrom.

20. A reinforced structure as claimed in claim 18 wherein said rod extension includes a structural element for interacting between adjacent reinforcing elements.

* * * * *